US005306552A

United States Patent [19]

Shimizu

[11] Patent Number: 5,306,552

[45] Date of Patent: Apr. 26, 1994

[54] MAGNETIC POSITION MARKER

[75] Inventor: Takao Shimizu, Kounosu, Japan

[73] Assignee: Nippon Felt Co., Ltd., Tokyo, Japan

[21] Appl. No.: 889,841

[22] Filed: May 27, 1992

[30] Foreign Application Priority Data

Apr. 10, 1992 [JP] Japan ..... 4-118413

[51] Int. Cl.[5] ..... B32B 7/00

[52] U.S. Cl. ..... 428/251; 428/259; 428/900; 340/551

[58] Field of Search ..... 428/246, 251, 257, 258, 428/259

[56] References Cited

U.S. PATENT DOCUMENTS

| | | | |
|---|---|---|---|
| Re. 33,740 | 11/1991 | Taguchi et al. | 178/19 |
| 4,183,989 | 1/1980 | Tooth | 428/195 |
| 4,725,490 | 2/1988 | Goldberg | 428/292 |
| 4,728,554 | 3/1988 | Goldberg et al. | 428/113 |
| 4,943,477 | 7/1990 | Kanamura et al. | 428/286 |
| 4,960,651 | 10/1990 | Pettigrew et al. | 428/607 |
| 5,001,331 | 3/1991 | Leestemaker | 235/375 |
| 5,003,291 | 3/1991 | Strom-Olsen et al. | 340/551 |
| 5,015,992 | 5/1991 | Strom-Olsen et al. | 340/551 |
| 5,015,993 | 5/1991 | Strom-Olsen et al. | 340/551 |
| 5,110,651 | 5/1992 | Massard et al. | 428/105 |

*Primary Examiner*—George F. Lesmes
*Assistant Examiner*—Chris Raimund
*Attorney, Agent, or Firm*—Marshall & Melhorn

[57] ABSTRACT

A magnetic marker, comprising a first fabric base sheet, a plurality of magnetized fibers attached to a surface of the first fabric base sheet by bonding means, and a second fabric base sheet secured to the surface of the first fabric base sheet so as to interpose the magnetized fibers between the first and second fabric base sheets. The magnetic marker using magnetized fibers can withstand repeated piercing which is encountered in the application for detecting the position of the ground fabric during the process of needling for the production of felt. The magnetized fibers are firmly secured between the two fabric base sheets, optionally reinforced by a multiplicity of perpendicularly arranged yarn, that the magnetized fibers can retain the capability to generate magnetic flux even after repeated use.

6 Claims, 6 Drawing Sheets

MAGNETIC POSITION MARKER

TECHNICAL FIELD

The present invention relates to a magnetic position marker, and in particular to a magnetic position marker which is suitable for use in controlling the process of producing press felt intended for use in paper making machines.

BACKGROUND OF THE INVENTION

In a paper making machine, water is removed from a wet web of paper fibers between a series of mutually opposing rolls by compressing the paper fiber web, and press felt in the form of an endless belt having a relatively large width is wrapped around such rollers. The press felt is fabricated by passing woven ground fabric in the form of an endless belt around rolls including a motor driven roll and guide rolls, and entangling fibers of fiber web consisting of layers of woollen or synthetic fiber web with the ground fabric by needling as the ground fabric is passed under a needle head along with the fiber web placed thereon.

During the process of needling, for the fibers to be favorably entangled with the ground fabric, it is necessary to adjust the stroke of needling, the density of needling and the feed speed of the ground fabric according to the number of turns which the ground fabric has made around the feed and guide rolls. Since the press felt must be highly smooth along the circumferential direction thereof without any steps or local irregularities, it is difficult to determine how many turns the press felt has made at any particular given time. Furthermore, since the time point of adjustment must coincide with the point of transition from one layer of fiber web to another, the detection of the rotation of the drive roll would not allow a sufficiently accurate detection of the position of the press felt during the process of needling.

Conventionally, the operator placed a red thread or made a red mark with dye or ink in the ground fabric to identify a reference point on the press felt, and manually made necessary adjustments by visually determining the number of turns the ground fabric had made. Therefore, the operator was required to count the number of turns the press web had made and quickly make necessary adjustments upon detection of such a marker. This required a high level of concentration, and the quality of the press felt was highly dependent on the quality of the operator. Therefore, there has been a strong demand to automate the process of felt fabrication by needling.

For automating the process of needling, it is preferable to be able to use a marker which can be easily detected with a sensor. However, conventionally known markers were inadequate because they tended to be quickly damaged by the process of needling in which the entire press felt including the sensor is repeatedly pierced by needles, and were rendered useless in a very short time.

In Japanese patent laid open publication No. 03-124866 filed jointly by the applicant of this application and two other applicants, it is proposed to prepare a magnetic marker by arranging a plurality of magnetized fibers parallel to each other on a two-sided adhesive tape, and securing it to a lateral fringe of the ground fabric of press felt so that the movement of the ground fabric may be detected with a magnetic sensor during the process of needling, and the process of needling can be automated by using an output signal from the magnetic sensor which accurately indicates the movement of the ground fabric. Further, since the marker basically consists of magnetized fibers, the needling process is not hampered by the presence of the magnetic marker, and the marker can withstand the repeated piercing by the needles.

However, since the magnetized fibers tended to be integrally combined with the ground fabric along with the fibers of fiber web as a result of the process of needling, the marker was not suitable for repeated use. Since the magnetized fibers typically consisting of amorphous alloy are highly expensive, it is more desirable if the magnetic marker can be used repeatedly.

BRIEF SUMMARY OF THE INVENTION

In view of such problems of the prior art, a primary object of the present invention is to provide a magnetic marker for an object such as an endless belt of such material as press felt which can retain its function as a marker even after being repeatedly pierced by needles, and is suitable for repeated use.

A second object of the present invention is to provide a magnetic marker which is capable of producing and retaining a high level of magnetic flux even after being pierced by needles a large number of times.

These and other objects of the present invention can be accomplished by providing a magnetic marker, comprising: a first fabric base sheet; a plurality of magnetized fibers attached to a surface of the first fabric base sheet by bonding means such as a two-sided adhesive tape; and a second fabric base sheet secured to the surface of the first fabric base sheet so as to interpose the magnetized fibers between the first and second fabric base sheets. Preferably, the magnetized fibers consist of amorphous metal or alloy which can produce a large magnetic flux.

Since the magnetized fibers are firmly secured between the first and second fabric base sheets, the magnetized fibers can be retained at their original positions between the two fabric base sheets even after being repeatedly pierced by needles. In particular, because the magnetized fibers are prevented from being displaced and entangled with the ground fabric of the felt, the magnetic marker can be easily detached from the completed felt, and can be used again. Thus, the magnetized fibers can continue to generate a high level of magnetic flux even after repeated use without requiring any replacement for the magnetized fibers, and economy and reliability can be achieved at the same time.

BRIEF DESCRIPTION OF THE DRAWINGS

Now the present invention is described in the following with reference to the appended drawings, in which.

DETAILED DESCRIPTION OF THE PREFERRED EMBODIMENT

Figure 1:
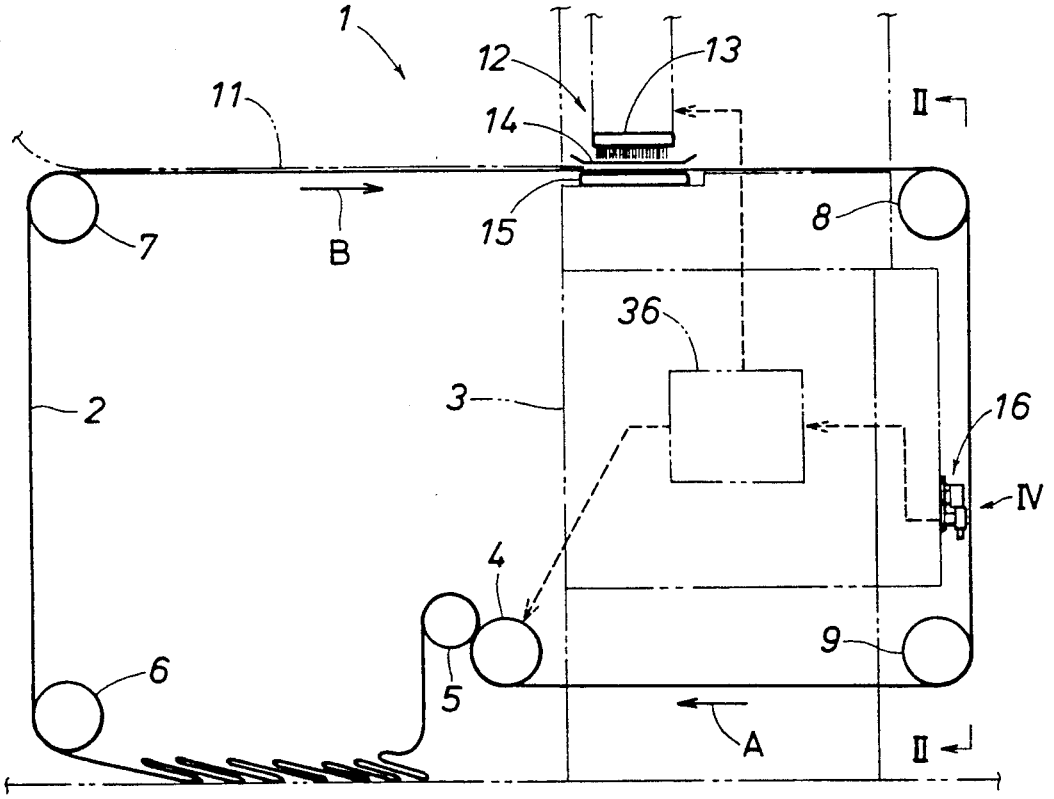
FIG. 1 is a schematic view illustrating the overall structure of apparatus for fabricating press felt incorporating an embodiment of the magnetic marker according to the present invention.
Figure 2:
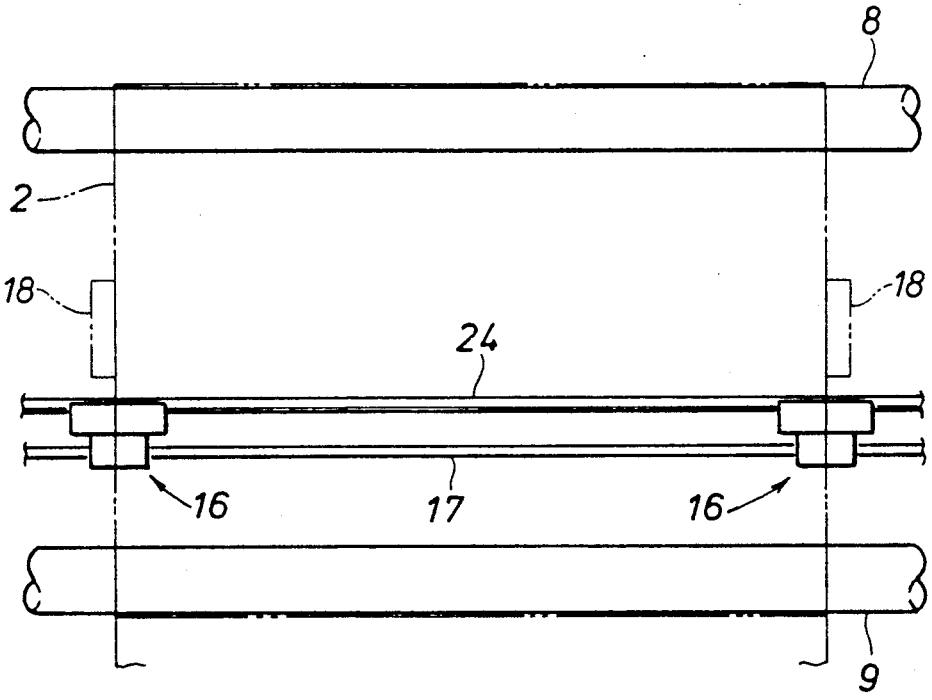
FIG. 2 is a sectional side view taken along line II—II of FIG. 1.

FIGS. 1 and 2 generally show a press felt fabricating device 1 according to the present invention. The press felt which is produced by this device 1 is used for removing water from wet paper in a paper making machine.

Ground fabric 2 consisting of an endless belt of woven fabric having a relatively large width is passed around a plurality of rolls in a main body of a needle machine 3 so as to travel around them in clockwise direction as illustrated in FIG. 1. More specifically, the ground fabric 2 is fed in the direction indicated by arrow A in FIG. 1 by being held between a drive roll 4 and a touch roll 5, and, after being fed out of the touch roll 5 and stored in a lower part of the device 1, is guided upward by a guide roll 6 to a brake roll 7 which, located above the guide roll 6, deflects the ground fabric 2 into a horizontal path extending between the brake roll 7 and a delivery roll 8 provided in an upper right part of the needle machine main body 3. The ground fabric 2 is fed along this horizontal path in the direction indicated by arrow B in FIG. 1, and, after being deflected downward by the delivery roll 8, is deflected horizontally toward the drive roll 4 by a guide roll 9 located under the delivery roll 8. In this way, the ground fabric 2 forms a complete loop which is passed around the rolls 4 through 9.

Layers of fiber web 11 are individually placed over the upper surface of the ground fabric 2 near the brake roll 7, and are each conveyed jointly with the ground fabric 2 as it is conveyed between the brake roll 7 and the delivery roll 8. The fiber web 11 is prepared from wool or synthetic fibers by a card machine not shown in the drawing, and is typically folded over into several layers before it is placed over the ground fabric 2 as a single fiber web.

An upper part of the main body of the needle machine 3 is provided with a needle punch unit 12 for entangling the fibers of the fiber web 11 with the ground fabric 2. This needle punch unit 12 is of a known structure, and comprises a needle head 13 having, on its lower surface, a multiplicity of needles arranged in a dense staggered arrangement and directed toward the upper surface of the ground fabric 2, a stripper plate 14 interposed between the needle head 13 and the ground fabric 2 and provided with a multiplicity of through holes corresponding to the needles of the needle head 13, and a bed plate 15 guiding the lower surface of the ground fabric 2 and provided with holes similar to the holes of the stripper plate 14.

A pair of sensor blocks 16 are provided each adjacent to either fringe of the ground fabric 3 as it is conveyed downward between the delivery roll 8 and the guide roll 9 along a vertical path. As illustrated in FIG. 2, each of the sensor blocks 16 is guided by a guide rail 17 fixedly secured to one side of the main body of the needle machine 3 so as to be moveable in a lengthwise direction or in a direction perpendicular to the feeding direction of the ground fabric 2 along the reverse surface of the ground fabric 2.

Figure 3:
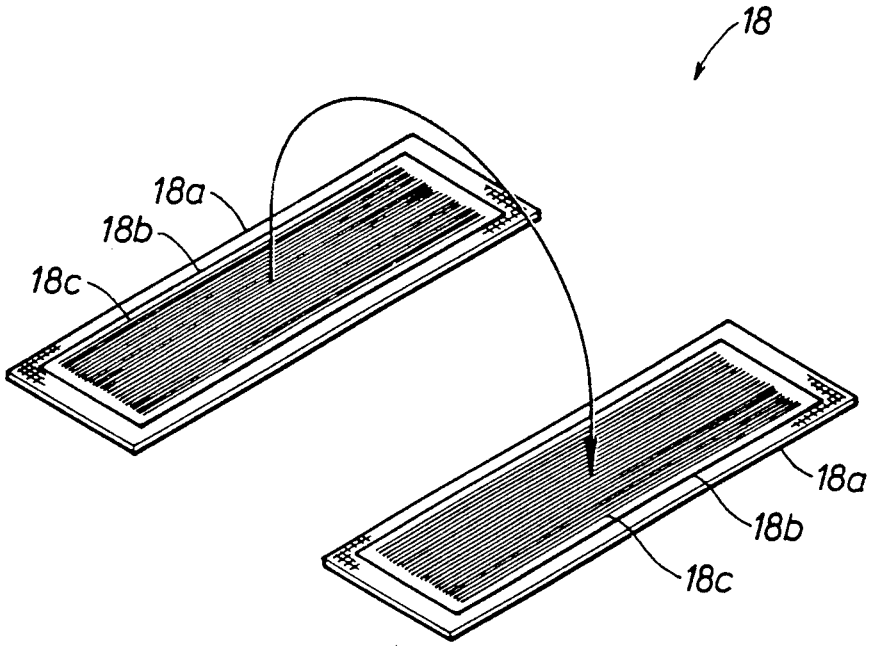
FIG. 3 is an exploded perspective view showing the structure of a magnetic marker according to the present invention.

According to the present embodiment, a marker 18 is secured to a lateral fringe part of the ground fabric 2 for detecting the movement of the ground fabric 2, and another similar marker is secured to an opposite fringe part of the ground fabric 2 so that the two markers 18 may be substantially aligned with each other in the lateral direction. As illustrated in FIG. 3, each of the markers 18 consists of two parts, each part comprising a fabric base sheet 18*a*, a two-sided adhesive tape 18*b* securely attached to a surface of the fabric sheet 18*a*, and a layer of magnetized fibers 18*c* secured to the other surface of the adhesive tape 18*b*. The two parts are joined together by bringing the surfaces of the adhesive tapes 18*b* carrying the magnetized fibers 18*c* together. The magnetized fibers 18*c* may consist of amorphous alloy fibers sold under the tradename of Sency by Unitika KK of Tokyo, Japan. The diameter of each of the magnetized fibers 18*c* may generally range between 15 micrometers to 125 micrometers, and may be in the order of 30 micrometers when #32 or #36 needles having a triangular crosss section are used. Further, in the present embodiment, the magnetized fibers are arranged in mutually parallel relationship.

The marker 18 constructed in this manner may be secured adjacent and along a lateral edge of the ground fabric 2 by passing threads through the fringe of the ground fabric 2 and the marker 18. The movement of the ground fabric 2 can be detected by magnetically detecting the presence of the layer of the magnetized fibers 18*c*.

Figure 5:
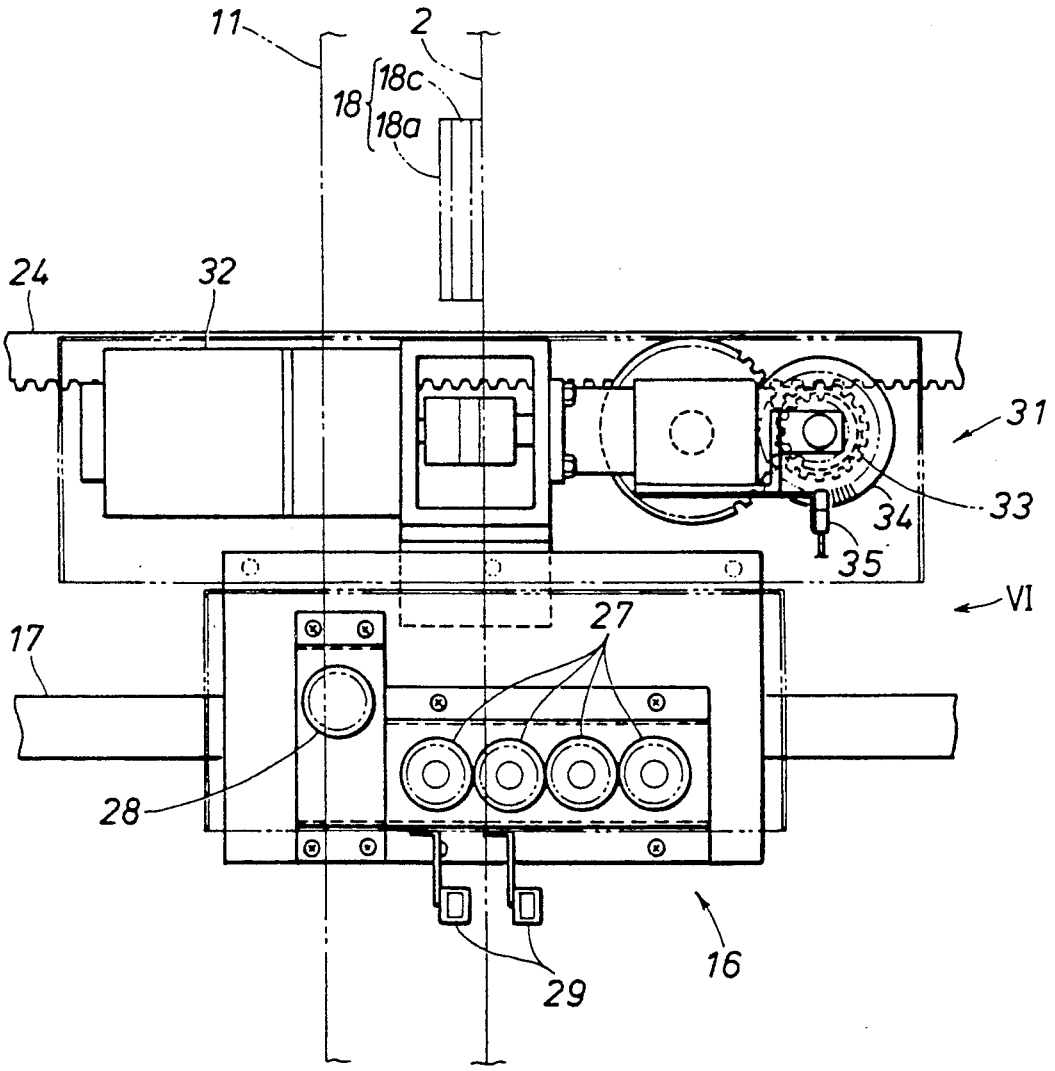
FIG. 5 is an enlarged front view of the sensor block as seen in the direction indicated by arrow V in FIG. 1.
Figure 6:
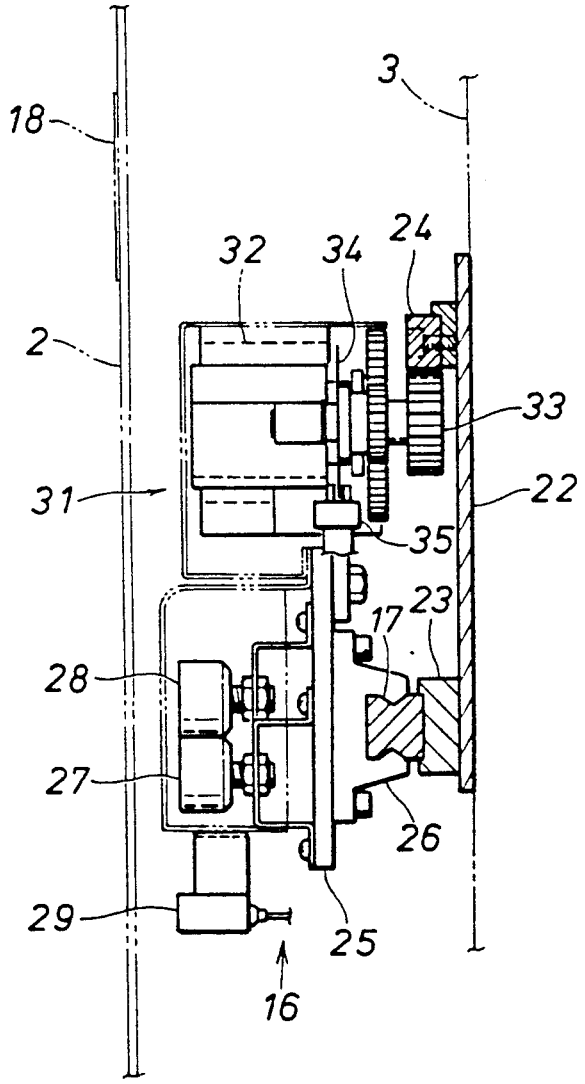
FIG. 6 is a side view as seen in the direction indicated by arrow VI in FIG. 5.

Referring to FIG. 6, the guide rail 17 is fixedly secured, via mounting block 23, to a support plate 22 fixedly secured to the side portion of the main body of the needle machine 3 as mentioned earlier, and a rack 24 is fixedly secured to the support plate 22 parallel to and vertically spaced apart from the guide rail 17. A slider 26 which is guided by the guide rail 17 is provided with a sensor mounting plate 25 for integrally carrying the sensor block 16, and the sensor mounting plate 25 carries magnetic sensors 27 for magnetically detecting the marker 18. As illustrated in FIG. 5, there are four such magnetic sensors 27 arranged in a row extending perpendicularly to the feed direction of the ground fabric 2 on each lateral side thereof. A part of the sensor mounting plate 25 corresponding to the outer edge of the ground fabric 2 is provided with a proximity sensor 28 for measuring the width of the ground fabric 2, and a pair of photoelectric sensors 29 are arranged under the proximity switch 28 and the magnetic sensors 27 for the tracking control of the sensor block 16 by photoelectrically detecting the edge of the ground fabric 2.

The upper end of the sensor mounting plate 25 is integrally connected to a motor unit 31 incorporating a motor 32. The output shaft of the motor 32 is connected to a pinion gear 33 via reduction gear unit, and the pinion gear 33 in turn meshes with the rack 24 which is fixedly secured to the mounting plate 22. Therefore, by driving the motor 32 in either direction, the sensor block 16 can be moved in a desired direction along the guide rail 17. The pinion gear 33 is coaxially connected to a slit disk 34 so that the travel of the sensor block 16 can be measured by photoelectrically counting radial slits provided in the slit disk 34 with a photoelectric rotation sensor 35. The sensors 27 through 29, the motor 32 and the rotation sensor 35 are electrically connected to a control unit 36 (FIG. 1) which controls the operation of the drive means for the needle punch unit 12 and the drive roll 4, and the brake torque of the brake roll 7 for applying an appropriate tension to the ground fabric 2.

Now the operation of the above described apparatus for fabricating press felt is described in the following.

First of all, ground fabric 2 in the form of an endless belt is passed around the rolls 4 through 9, and a pair of markers 18 are attached to reference points on the side fringes of the ground fabric 2. The ground fabric 2 is then driven in the direction indicated by arrow A in FIG. 1 with the drive roll 4 so that the needling of fiber web 11 into the ground fabric 2 may be carried out over the entire area of the ground fabric 2. Prior to this needling process, the sensor blocks 16 are positioned at their respective initial positions located on either side end of the main body of the needle machine 3.

After the ground fabric 2 has started moving, either automatically or by manually operating a start switch of each sensor block 16 not shown in the drawings, each of the sensor blocks 16 is moved toward the corresponding edge of the ground fabric 2, and is thereafter made to follow the edge of the ground fabric 2 even in the presence of the lateral wiggling of the ground fabric owing to the tracking control of the sensor block 16 by the photoelectric sensors 29. Therefore, every time the ground fabric 2 makes a full turn around the series of rolls 4 through 9, the marker 18 passes near the corresponding magnetic sensors 27, and the reference point of the ground fabric 2 can be detected in a reliable fashion. Every time the magnetic sensors 27 have detected the marker 18 or every time the ground fabric has made a full turn, the sensor block 16 is moved inwardly so that the proximity sensor 28 may detect the edge of the ground fabric 2, and measure the width of the ground fabric 2 for the convenience of the evaluation of the quality of the press felt that is going to be produced.

The fiber web 11 is integrally joined with the ground fabric 2 as the needles of the needle punch unit 12 are repeated pierced through the fiber web 11 and the ground fabric 2, and the fibers of the fiber web 11 get entangled with the ground fabric 2. Upon completion of the needling of the first layers of fiber web 11, second layers of fiber web 11 are placed thereon, and are likewise subjected to a similar needling process. This process is repeated 4 to 7 times before the final press felt is produced.

During the process of needling, it is necessary to adjust the needling stroke and the needling density by the needle punch unit 12 according to the number of turns the ground fabric 2 has made and the different layers of the fiber web. According to the present invention, the number of turns the ground fabric 2 has made can be automatically detected by detecting the markers 18 with the magnetic sensors 27. The signals detected by the magnetic sensors 27 are supplied to the control unit 36 so that the drive means for the needle punch unit 12 and the drive roll 4 and the brake means for the brake roll 7 can be automatically controlled to optimum levels for each different turn which the ground fabric makes.

Since the markers of the present embodiment consist of a plurality of extremely fine metallic fibers arranged in a mutually parallel relationship, the needles of the needle punch unit would not encounter any obstacle as they are pierced through the ground fabric, and, therefore, would not be damaged by the markers even after a long use. Further, since the metallic fibers of the markers 18 would also not be damaged or dispersed by the needles, they retain their capability as markers at all times. In particular, since the magnetized fibers 18*c* are firmly secured between the two fabric base sheets 18*a* via two-sided adhesive tapes 18*b*, the magnetized fibers 18*c* are prevented from being dislodged from the fabric base sheets 18*a*.

In the case of the magnetic marker of the prior structure in which magnetized fibers are simply attached to the ground fabric of the felt via a two-sided adhesive tape, the magnetized fibers were required to be of a sufficiently small diameter because the magnetized fibers have a tendency to be detached from the marker during the process of needling and such loose magnetized fibers may cause undesirable irregularities on the surface of the fabricated felt unless the diameter of the magnetized fibers is extremely small. Obviously, magnetized fibers having an extremely small diameter require a special care in handling, and are relatively expensive to fabricate.

However, according to the present invention, since the magnetized fibers are firmly secured between a pair of fabric base sheets, and would not be detached or otherwise exposed from the fabric base sheets, the magnetized fibers are prevented from being entangled with the ground fabric of the felt along with the fibers of the fiber web, and the quality of the produced felt would not be impaired in any way as a result of the use of such magnetic markers. Further, since the markers are magnetically detected, the markers may be detected even when the ground fabric is reversed for needling from the reverse surface of the ground fabric.

According to the above described embodiments, since the magnetized fibers are initially secured to each of the surfaces of the two-sided adhesive tapes of the two halves of the magnetic marker before these two halves are combined, it is possible to secure a relatively large number of magnetized fibers within the magnetic marker, and to increase the magnetic flux produced therefrom as compared to the prior structure mentioned above. In this case, the magnetized fibers are 30 micrometers in diameter, and may be arranged at density of 15 to 70 fibers per cm, more preferably at the density of 34 fibers per cm.

According to the present invention, the magnetized fibers are so firmly secured within the marker that the magnetized fibers would not spread out, and the magnetic flux would therefore not be reduced even after long use. Further, the structure of the present invention allows the use magnetized fibers having a wide range of diameter, and the cost of the magnetic marker can be reduced. When magnetized fibers of a relatively large diameter is used, it is possible to produced an accordingly large magnetic flux.

As described above, the magnetic marker of the present invention can be detachably attached to the ground fabric with suitable means such as thread which would not hamper or get damaged by the process of needling without involving any substantial disintegration, it can be easily detached from the ground fabric for repeated use.

The fabric base sheets 18*a* of the present embodiment measured 2 cm in width, 8 cm in length, and 3 mm in thickness, but may have other sizes and thicknesses for different applications. However, the thickness may be preferably between 0.8 and 4 mm, more preferably between 2 and 3 mm, for the process of fabricating press felt for paper making by needling. The fabric base sheets may be woven from durable fibers such as polyester using yarn of yarn number metric count 8 made by twisting a pair of yarns each of yarn number metric count 16. The weight of the fabric base sheets is typically 400 g/m$^2$, and the magnetic marker is made by combining two of such fabric base sheets. The warp and weft of the fabric base sheets may consist of synthetic fiber yarns such as polyester and polyamide or natural fiber yarns such as cotton and wool, and may also be either woven, non-woven or knit fabric.

Figure 4:
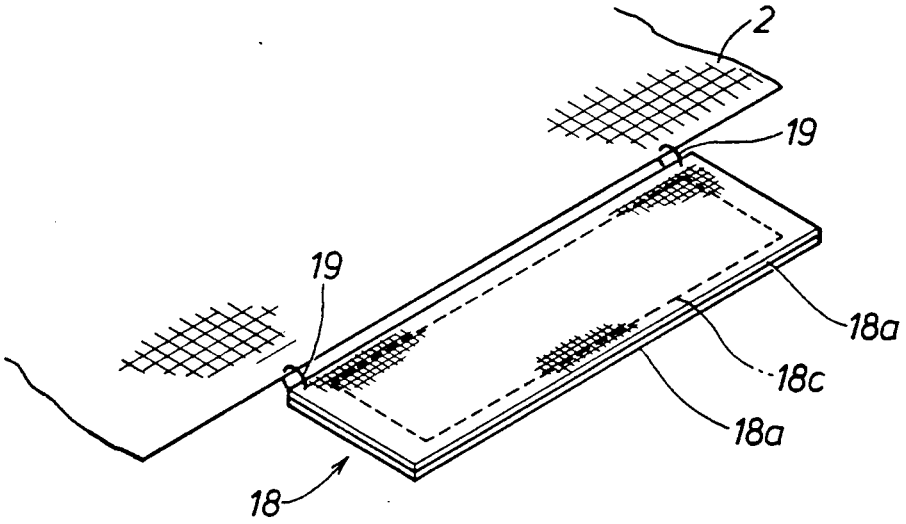
FIG. 4 is a perspective view showing how a magnetic marker may be attached to ground fabric of press felt.

When the magnetic marker is attached to a lateral edge of the ground fabric so as to be located externally of the edge as illustrated in FIG. 4, the fabric base sheet should have a relatively large weight so as to retain its shape. When the magnetic marker is attached to a lateral edge of ground fabric so as to be located internally of the edge, it is preferable to place fiber web over the ground fabric and secure the magnetic marker over the layer of the fiber web using thread along a lengthwise edge of the magnetic marker. In this case, the fabric base sheet should have a relatively small weight so as to able to pass through the gap between the stripper plate 14 and the felt which is being produced. When these possibilities a considered, the weight of the fabric base sheet should be between 150 and 800 g/m$^2$, more preferably between 300 and 450 g/m$^2$.

Figure 7:
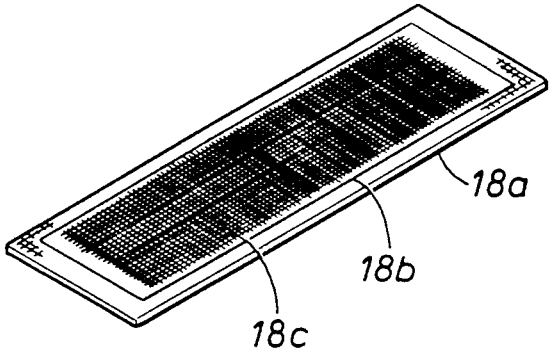
FIG. 7 is a perspective view of one of two halves of a modified embodiment of the magnetic marker according to the present invention.

Optionally, as illustrated in FIG. 7, the magnetized fibers may be woven or otherwise combined with yarn, preferably spun yarn, extending perpendicularly to the orientation of the magnetized fibers. Preferably, the magnetized fibers may be woven with synthetic or natural spun fiber yarn using these two materials as weft and warp, respectively. This structure further increases the durability of the magnetic marker.

Alternatively, the magnetized fibers may be combined with multi-filament yarn, mono-filament yarn, twisted matallic fiber yarn or metallic mono-filament yarn. The yarns may be combined not only by weaving but also by entangling them or otherwise combining them. For instance, polyester fibers may be placed perpendicularly over a multiplicity of magnetized fibers arranged in parallel orientation, and thermally welding the intersections of these fibers as illustrated in FIG. 7 in which like parts are denoted with like numerals. Alternatively, a bonding agent may be employed for joining such intersections. The use of perpendicularly extending fibers or yarn can even further improve the capability of the present invention to retain the magnetized fibers in the original arrangement without undesirable disturbances and spreading even after repeated use.

According to the present invention, magnetized fibers are firmly secured between two fabric base sheets, optionally reinforced by a multiplicity of perpendicularly arranged yarn, the magnetized fibers can retain the capability to generate magnetic flux even after repeated use.

Although the present invention has been described in terms of specific embodiments, it is possible to modify and alter details thereof without departing from the spirit of the present invention. For instance, the markers and the system for detecting the markers are useful not only in the production of press felt, but also in other production processes where detection of the position of an object is required.

What we claim is:

1. A magnetic marker for detection by a magnetic sensor in a process control system, the magnetic marker being secured to a ground fabric during fabrication of material in a needle press, said magnetic marker comprising:

a first fabric base sheet;

a plurality of magnetized fibers attached to a surface of said first fabric base sheet in parallel spaced-apart relationship by an adhesive layer on the surface of said base sheet;

a plurality of fibers for reinforcing and securing said magnetized fibers, said reinforcing fibers being combined with said magnetized fibers and secured to said first base sheet by the adhesive layer; and a second fabric base sheet secured to said surface of said first fabric base sheet so as to interpose said magnetized fibers and said reinforcing fibers between said first and second fabric base sheets whereby said reinforced magnetized fibers are maintained between said first and second fabric base sheets for proper detection by the magnetic sensor during the needling of the ground fabric wherein said magnetic marker is adapted to be secured to ground fabric used for the production of felt.

2. A magnetic marker according to claim 1, wherein intersection between said magnetized fibers and said fibers or filaments for reinforcement are joined together by welding.

3. A magnetic marker according to claim 1, wherein intersection between said magnetized fibers and said fibers or filaments for reinforcement are joined together by a bonding agent.

4. A magnetic marker according to claim 1, wherein said magnetized fibers are oriented substantially parallel to each other and are woven with said reinforcing fibers extending perpendicular to the orientation of the magnetized fibers.

5. A magnetic marker according to claim 1, wherein said magnetic marker includes means for selectively attaching said marker to a lateral edge of said ground fabric so as to be located externally of the lateral edge.

6. A magnetic marker for detection by a magnetic sensor in a process control system, the magnetic marker being secured to a ground fabric during fabrication of material in a needle press, said magnetic marker comprising:

a first fabric base sheet having a density between 150 and 800 g/m$^2$;

a plurality of magnetized fibers attached to a surface of said first fabric base sheet by an adhesive layer on said surface;

a plurality of fibers or filaments for reinforcement, said magnetized fibers and said fibers or filaments for reinforcement being woven together as warp and weft, respectively; and a second fabric base sheet having a density between 150 and 800 g/m$^2$ and being secured to said surface of said first fabric base sheet so as to interpose said magnetized fibers and said reinforcement fibers or filaments between said first and second fabric base sheets whereby said marker is thin enough to pass through said needle press secured on said ground fabric, and whereby, after multiple engagements with the needle press, said magnetized fibers are maintained and reinforced between said first and second fabric base sheets for proper detection by the magnetic sensor during the needling of the ground fabric wherein said magnetic marker is adapted to be secured to ground fabric used for the production of felt.

* * * * *